US005467946A

United States Patent [19]

Doehler

[11] Patent Number: 5,467,946

[45] Date of Patent: Nov. 21, 1995

[54] CIRCUIT ARRANGEMENT FOR THE BUSY INDICATION OF TRACK SECTIONS OF A MODEL RAILWAY

[76] Inventor: Peter Doehler, Kaulbachstrasse 59, 80539 Munich, Germany

[21] Appl. No.: 321,437

[22] Filed: Oct. 11, 1994

[30] Foreign Application Priority Data

Oct. 16, 1993 [DE] Germany ..... 43 35 380.0

[51] Int. Cl.[6] ..... A63H 19/00

[52] U.S. Cl. ..... 246/122 A; 246/34 B; 246/28 D; 246/86; 246/90; 246/92

[58] Field of Search ..... 246/34 R, 35, 246/36, 34 B, 61, 62, 72, 86, 87, 90, 92, 28 D, 28 F, 122 R, 122 A, 124; 104/295, 296, 297

[56] References Cited

U.S. PATENT DOCUMENTS

| | | | |
|---|---|---|---|
| 3,333,096 | 7/1967 | Ohman et al. | 246/34 R |
| 3,433,942 | 3/1969 | Gilbert et al. | 246/34 R |
| 3,879,004 | 4/1975 | Andreasen | 246/34 R |
| 3,891,167 | 6/1975 | Perry | 246/34 R |
| 3,907,238 | 9/1975 | Sibley et al. | 246/34 R |
| 3,958,781 | 5/1976 | Woods et al. | 246/34 R |
| 3,979,092 | 9/1976 | Perry et al. | 246/34 R |
| 3,994,237 | 11/1976 | Thomsen | 104/295 |
| 4,320,881 | 3/1982 | Campbell | 246/34 R |
| 4,487,385 | 12/1984 | Salmon | 246/34 R |
| 5,263,669 | 11/1993 | Ehrlich | 246/34 B |
| 5,330,135 | 7/1994 | Roberts | 246/34 B |

*Primary Examiner*—Mark T. Le

*Attorney, Agent, or Firm*—Shlesinger, Fitzsimmons & Shlesinger

[57] ABSTRACT

The invention refers to a circuit for the busy indication of track sections (1, 2, 3, 4) electrically isolated from each other of a model railway system digitally controlled by a control center (Z). After a controlled digital receiver (E) of an engine determines its own address code with the help of a decoding device, it provides a busy signal via a signal generator (8) to the assigned busy indicator (BM3). To simplify the circuit considerably and to be able to do without the the RF-signal generators so far used in the engine and corresponding RF-receivers of the busy indicator, the signal generator of each engine (A, B) comprises a d.c. source providing a busy signal of a given polarity corresponding to the engine direction on the track as the busy signal to the busy indicator (BM3). Each busy indicator (BM3) comprises a direct voltage comparator (20) which can measure the busy signal received in zero-volt measurement gaps of the control signal and thus makes it possible to assign the engine designation to a given track section as well as the position of the engine on the track.

6 Claims, 3 Drawing Sheets

Figure 1:
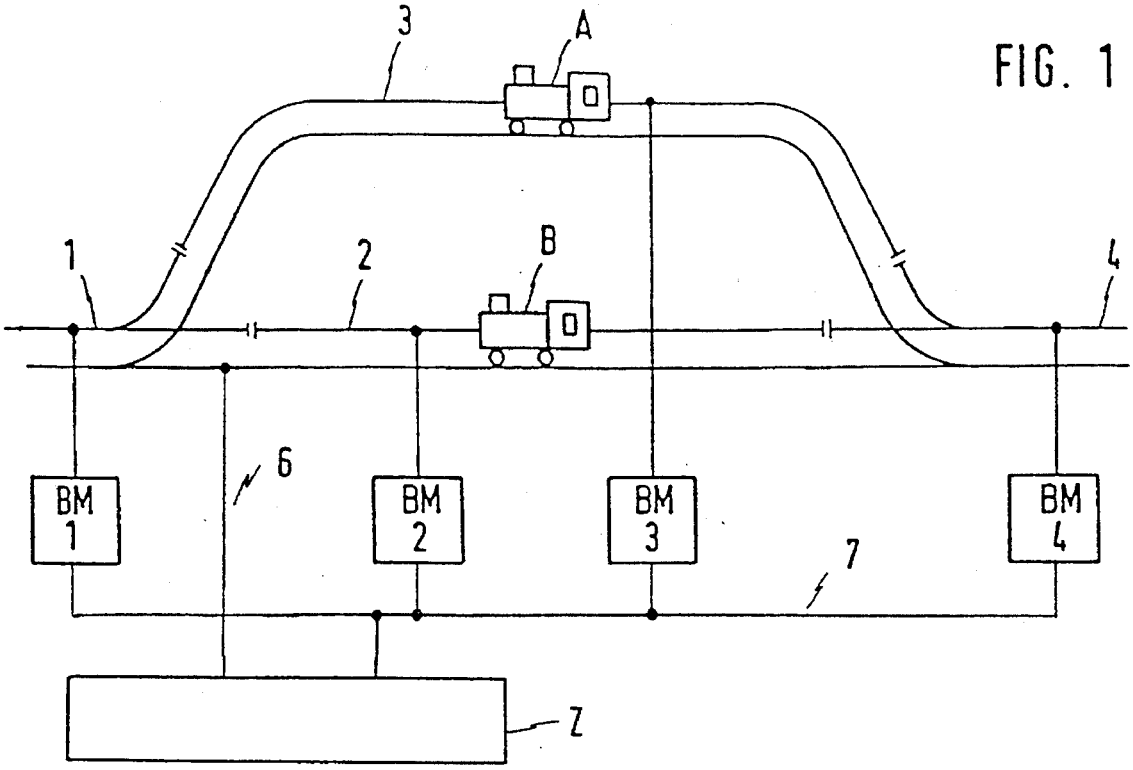

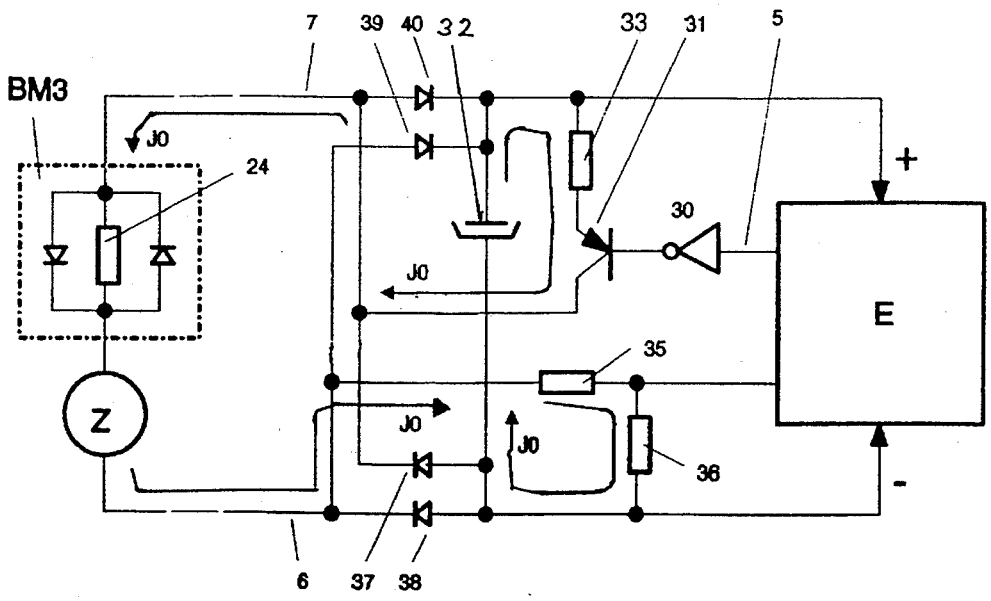
Fig. 3
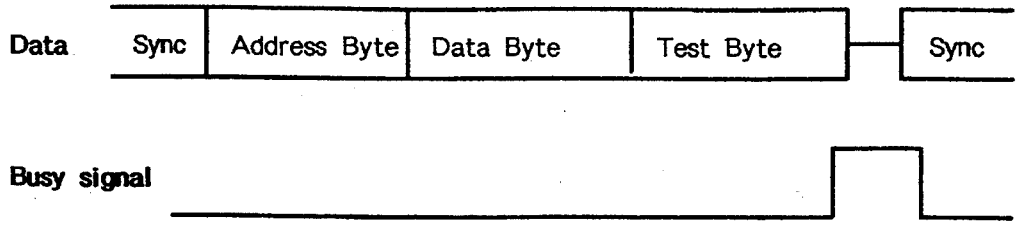
Fig. 4
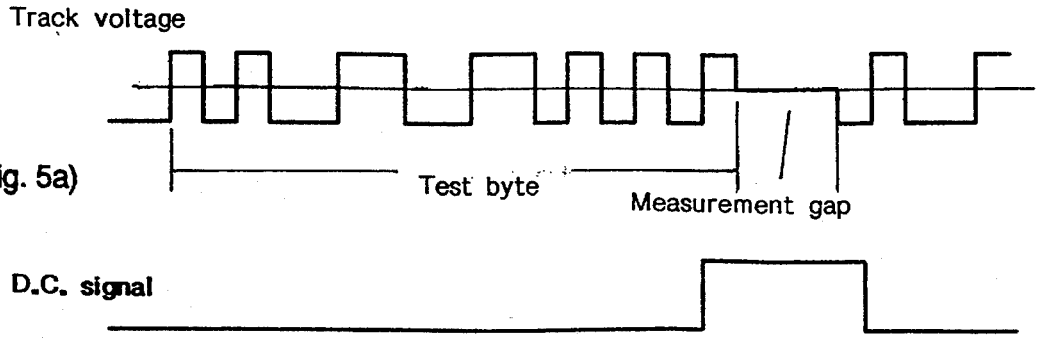
Fig. 5a)
Fig. 5b)

CIRCUIT ARRANGEMENT FOR THE BUSY INDICATION OF TRACK SECTIONS OF A MODEL RAILWAY

The invention refers to a circuit for the busy indication of track sections.

Such a circuit is known from DE-A-36 18 530.2. A cyclic control signal controlled via a time multiplexer for every track section comprising a different address code for every engine addresses the individual engines successively and only determines whether there is an engine or not. Here it does not matter which format the data packet for every individual engine has and which pulse shape is used to control the engines. After an engine has recognized its own address with the help of its own decoding device, it generates a corresponding busy signal. For this purpose every engine has a signal transmitter comprising an RF-generator generating the respective busy signal and transmitting it to a busy indicator assigned to each track section comprising a corresponding RF-receiver. This circuit is comparatively expensive, it furthermore does not permit to determine in which direction the respective engine is facing on the track (e.g. engineer's cab 1 left).

It is the object of the invention to considerably simplify a circuit for identifying a given engine on a given track section. This shall be achieved without an RF-generator in the engine and an RF-receiver in the busy indicator.

In accordance with the invention this object is solved as noted in greater detail hereinafter.

According to a preferred embodiment it shall also be possible to determine the direction of the engine on a given track section. The busy indicator for every track section comprises a comparator assigning the busy signal of the engine received to the previous control signal of the control center. It is thus possible to assign a given engine number or a given engine name to a given track section.

A d.c. source providing a corresponding direct voltage signal to the assigned busy indicator is used as signal transmitter within each engine. If a detecting device for the polarity of the d.c. signal of the engine or its signal generator, respectively, is provided in the busy indicator, it is also possible to determine the position or the direction of the engine on the given track section, respectively.

Figure 2:
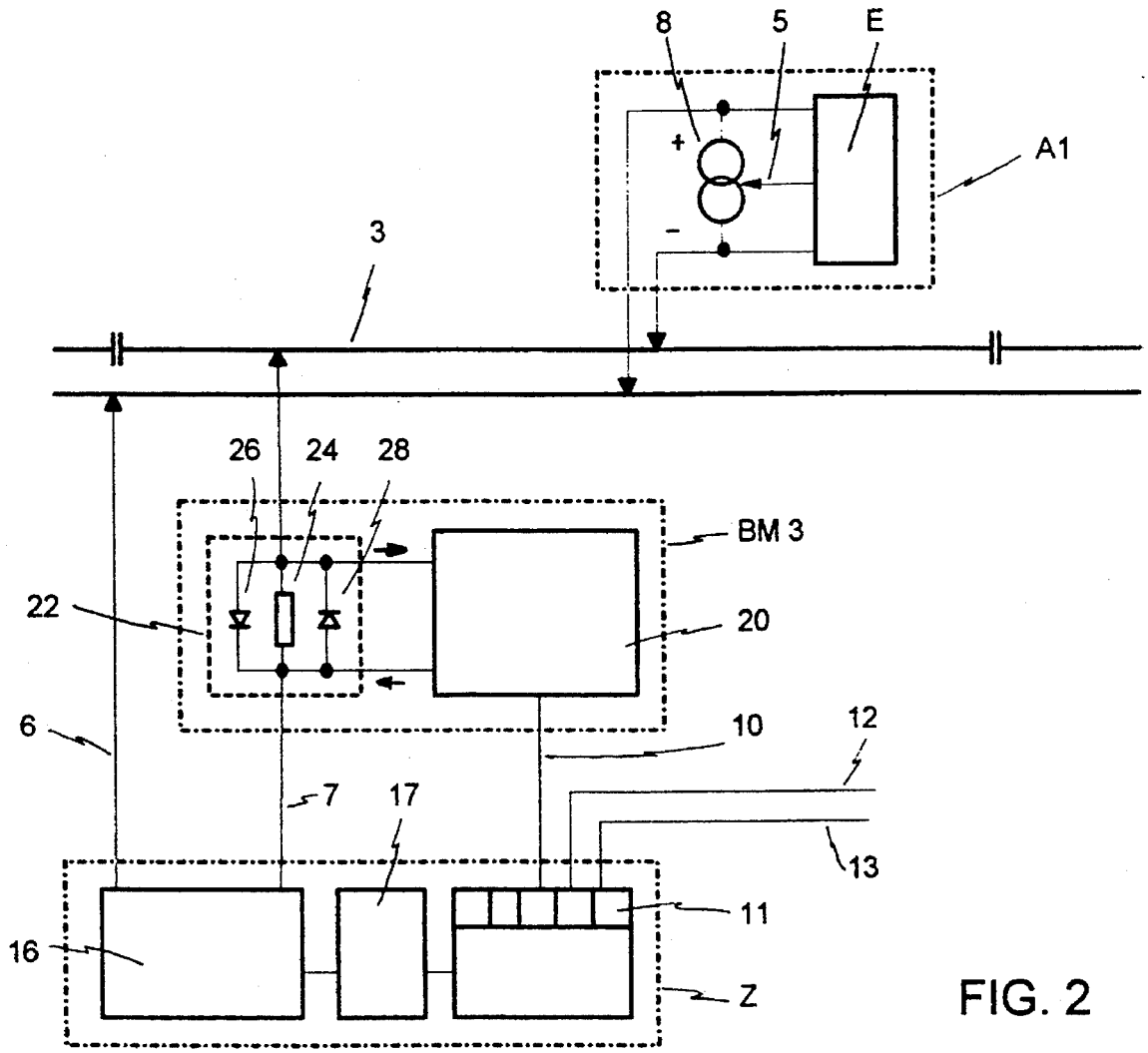

One embodiment of the invention is illustrated by the drawing:

FIG. 1 shows the scheme of a track system with several track sections and two engines, FIG. 2 shows the overall scheme of the circuit, FIG. 3 shows a detailed circuit arrangement of the signal generator, FIG. 4 shows the example of the data format for the control signal to the engine, FIG. 5*a* shows a sequence of signals of the central control signal to the engine FIG. 5*b* shows the busy signal transmitted by the controlled engine to the busy indicator in the form of a d.c. signal.

FIG. 1 shows the overall scheme of a model railway system with four track sections 1, 2, 3, 4, an engine B being positioned on track section 2 and an engine A on track section 3. Each of the track sections is circuit-connected to an assigned busy indicator BM1, BM2, BM3, or BM4, respectively. Each of the track sections is directly connected with the control center Z via a first line 6. The second line 7 is connected with the control center Z via the decoder circuit 22 of the respective busy indicator. This control center, preferably in the time multiplex procedure, generates the control signals for controlling the engines. Each control signal for each engine among other things only comprises one address signal characterizing it as well as digital control signals. If, and only if this engine receives its own address signal, it generates a busy signal which is transmitted via the corresponding track section to the electrically connected busy indicator and which can there generate an indicator signal which is preferably transmitted further to the control center.

FIG. 2 shows the overall circuit of engine A, only the circuit arrangement A1 including the digital receiver E being shown schematically. The circuit arrangement is circuit-connected to the respective busy indicator BM3 and the control center Z via track section 3.

The digital receiver E of every engine comprises a continuous pulse train of the control signal of control center Z, it compares the address code comprised therein with the one to which it is adjusted itself and upon conformance it processes the subsequent control signals, like with respect to the direction of motion or speed of motion. It further provides a signal on the output line 5 to the signal generator 8, if it recognizes its address in the present control signal generated by the control center Z.

In a known procedure a synchronizing signal is at first transmitted to all track sections which in a given individual interval herefrom is every time followed by an individual digital control signal every time corresponding to the given engine. In this case the output signal on line 5 of the digital receiver E can either be generated by a respective time delay of the synchronization signal characteristic for the engine or the output signal on line 5 occurs when the given sequence of digital signals for the respective engine has been received by the digital receiver and can be determined by a detector circuit.

If the control center Z is, however, designed in such way that it first sends digital address signals to call the receivers of the individual engines and then always subsequently the respective digital control signals, either the individual address signals can be decoded or the digital control signals occuring thereafter can be detected in the digital receiver E of the individual engines A, B to generate the output signal on line 5.

For the object of the invention, the control signal on the output line 5 of the digital receiver E triggers off a given d.c. pulse corresponding to the polarity of the power source which is led to the respective busy indicator BM3 via the tracks of track section 3. The busy indicator BM3 like the other busy indicators too comprises a comparator 20 as well as a decoder circuit 22 which via a resistor 24 is connected with a line 7 of the two lines 6, 7 which lead from the signal source 16 to generate the digital control signals to the two tracks of track section 3. To the two supply lines of line 7 to the comparator 20 parallel to the resistor 24 two diodes 26, 28 are connected antiparallelly or in opposition to each other. This decoder circuit serves to determine the polarity of a busy signal received from circuit arrangement A1 of engine A. The decoder circuit of comparator 20 serves the transformation of a d.c. signal of signal generator 8 into a voltage value and the limitation of the voltage dropping at this resistor 24 with the diodes 26, 28.

To recognize the d.c. signal of the signal generator it is necessary that the digital voltage of the control signal transmitted to the engine via track section 3 is zero volt for a certain time which is already the case for some digital systems currently used. One can here talk of a measurement gap. It is thus achieved that the diodes of the busy indicator BM3 become highly resistive and—without opposite current of the engine—zero-volt voltage drop is measured. If an engine addressed by a control signal sends a power pulse as a busy signal, the diode in the busy indicator becomes conductive again, a voltage drop can be measured.

During recognition of the direct voltage pulse generated by engine A the busy indicator assigns this signal to the engine the address signal of which was comprised in the address signal released immediately prior to the control signal for the respective track section. By this way it is possible to assign an engine to a given track section.

As already mentioned above, the polarity of the direct voltage dropping at the diodes can also recognize the determination of the direction of the engine on the track section. It can be seen from FIG. 2 that upon turning the engine on the track by 180° the polarity of the d.c. signals on the track is also changed. As known, for digital systems there is no relation between the indication of the direction of motion and the actual direction of motion on the system, on the contrary, the direction of motion is engine-related. If a digital engine moving in one direction is turned on the track, it continues to move forward from the engine's point of view, but from the spectator's point of view it moves into the opposite direction. The indication of the direction made possible here refers to the position of the engine on the track system. From the linkage direction of motion (engine-related) XOR-position of the engine, the system-related direction of motion can be determined, which is highly advantageous, especially for a control of the system with the help of a computer.

FIG. 3 detailedly shows a detailed drawing of the controllable power source used in the receiver E of circuit arrangement A1.

The control signal 5 at the output line of the digital receiver E conductively controls the transistor 31 via the inverter 30. The power $J_O$ flows from the engery-storage condensor 32 via the resistor 33 and the transistor 31 to the busy indicator BM3 and via the control center Z, which at the point of measurement releases 0 V, back again via the resistors 35, 36 into the condenser 32. The upper diodes 39, 40 with the lower diodes 37, 38 form a rectifier bridge at the entrance of which there is the track reverse current admitted from tracks 6, 7 and at the exit of which a direct current to operate the digital receiver E is generated. The condenser 32 positioned between the two groups of diodes (39, 40; 37, 38) here serves as a frequency filter and for storing energy. The controllable source of power itself comprises the transistor 31, the inverter 30 and the resistor 33 of the transistor circuit.

FIG. 4 shows the example of a purposefully used data format starting with a sync signal followed by an address byte for the respective engine addressed, followed by the data byte comprising the information intended for the engine, normally the control signals, e.g. for the direction of motion and the speed of motion. After that a test byte follows and after a certain intervall a next sync signal and so on. Below the control signal of the controllable power source is shown which also corresponds to the power pulse transmitted to the tracks and from there on to the busy indicator which is referred to as the busy signal, the beginning of the pulse of the pulse sequence being insignificant. The end of the pulse sequence should be during the next following sync byte at the latest.

FIG. 5 a shows an illustration of the test byte as well as of the measurement gap for the d.c. pulse. In FIG. 5*b* the d.c. pulse in the area of the measurement gap is shown which is transmitted from the signal generator to the assigned busy indicator.

I claim:

1. A circuit for producing a busy signal when an engine is positioned on any of a plurality of track sections (1,2,3,4) electrically isolated from each other in a model railway system including a plurality of engines digitally controlled by a control center (Z) having one busy indicator (BM) assigned to each track section, each of said engines including a digital receiver (E) and a signal generator (8) responsive to receipt of a predetermined address signal from said control center to transmit a busy signal to the busy indicator (BM) associated with the track section upon which the respective engine is positioned, said control center being operative to transmit intermittently a digital control signal and address signal to each track section and to the digital receiver (E) of any engine positioned thereon, each digital receiver (E) of a respective engine comprises a decoding device, which only effects operation of its associated signal generator (8) upon conformance of the received address signal with its predetermined address signal, and each digital control signal of the control center (Z) comprises a different address signal for each engine, and whereby each of said engine is identified by assigned control signals and busy signals, and characterized in that:

a) the signal generator (8) of each engine comprises a d.c. source providing a d.c. signal of a given polarity to the associated busy indicator as a busy signal, b) each busy indicator includes one direct voltage comparator (20), c) and means is operative between the intermittent digital control signals to produce voltage-free sections as measurement gaps whereby the d.c. signal is determined by the comparator.

2. A circuit according to claim 1, characterized in that each direct voltage comparator (20) determines the polarity of the busy signal supplied thereto by a respective signal generator (8) from which the present position of the associated engine on a given track section is determined.

3. A circuit according to claim 1 or 2, characterized in that the d.c. comparator (20) is connected in series to a decoder circuit (22) consisting of a resistor with two anti-parallelly connected diodes.

4. A circuit according to claim 1, characterized by a switchgear for cyclic subsequent control of the individual track sections with the control signals comprising the different address codes.

5. A circuit according to claim 1, characterized by a time multiplex circuit intermittently sending out the individual control signals in a given time interval from each other or to a synchronous signal to the individual track sections (1–4), respectively.

6. A circuit according to claim 1, characterized in that each busy indicator upon recognition of a d.c. pulse received from a respective controlled engine on its associated track section, assigns the last address signal provided from the control center (Z) as engine designation for the engine on this associated track section.

* * * * *